United States Patent [19]

Kovats

[11] 3,991,962

[45] Nov. 16, 1976

[54] SELF-LEVELING MECHANISM

[75] Inventor: Laszlo I. Kovats, Dayton, Ohio

[73] Assignee: General Motors Corporation, Detroit, Mich.

[22] Filed: Apr. 5, 1976

[21] Appl. No.: 673,722

[52] U.S. Cl. ..... 248/188.5; 248/188.3

[51] Int. Cl.[2] ..... F16M 11/26; F16M 11/24

[58] Field of Search ..... 248/23, 446, 188.1, 248/188.2, 188.3, 188.4, 188.5; 312/249, 253

[56] References Cited

UNITED STATES PATENTS

| | | | |
|---|---|---|---|
| 467,811 | 1/1892 | Humphreys | 248/188.3 |
| 2,540,750 | 2/1951 | Morrison | 312/253 UX |
| 2,695,147 | 11/1954 | Castricone | 248/188.3 X |
| 2,710,239 | 6/1955 | Lobendank | 248/188.5 |
| 2,908,472 | 10/1959 | McDonald | 248/188.3 UX |
| 3,215,383 | 11/1965 | Wright | 248/188.3 |
| 3,304,032 | 2/1967 | Yates | 312/253 X |
| 3,768,766 | 10/1973 | Bain | 248/188.2 |
| 3,880,388 | 4/1975 | Beguin | 248/188.3 |
| 3,954,241 | 5/1976 | Carlson | 248/188.3 |

FOREIGN PATENTS OR APPLICATIONS

| | | | |
|---|---|---|---|
| 316,117 | 11/1956 | Switzerland | 312/249 |
| 394,848 | 7/1933 | United Kingdom | 248/188.3 |
| 283,045 | 10/1971 | U.S.S.R. | 248/188.3 |

*Primary Examiner*—Lawrence J. Staab
*Attorney, Agent, or Firm*—Frederick M. Ritchie

[57] ABSTRACT

A mechanism for completely self-leveling all four legs of an appliance cabinet includes a polypropylene foot at each corner of the cabinet. Each foot is interconnected by a continuous cable for vertical movement in unison relative to the cabinet and to each other. Each foot has an elongated slot for receiving and blocking a wedge through the outboard side thereof. A locking cable connects the inboard side of each wedge to an adjusting lever at the front of the cabinet. After the cabinet has been leveled, the adjusting lever is moved to pull the wedges into locking engagement with the sides of their respective slots, thereby to lock each foot in fixed relation with the cabinet.

4 Claims, 6 Drawing Figures

SELF-LEVELING MECHANISM

Cabinet leveling is a common problem, especially in the installation of domestic appliances. Where the floor or mounting surface is uneven, the problem is made more difficult. The common solution is to locate the cabinet and then adjust each leg, generally by screwing or unscrewing the leg until the desired cabinet stance is achieved. Some prior art arrangements have interconnected pairs of legs to simplify the task but none have interconnected all the legs in the improved cable arrangement of this invention to achieve self-leveling of the cabinet.

Accordingly, it is an object of this invention to provide a leg adjusting device for a four-legged, self-leveling cabinet in which all legs are adapted for movement substantially in unison as the cabinet is leveled, the legs then being locked with the cabinet in the desired position by the substantially simultaneous insertion of a wedge in each leg.

A further object of this invention is the provision of a leg adjusting device for a four-legged, self-leveling cabinet in which all legs are movable in unison as the cabinet is leveled, the legs then being locked with the cabinet in the desired position by the simultaneous insertion of a wedge in each leg, and in which the cabinet is suspended on the legs by a continuous cable of predetermined length encircling said cabinet.

A further object of this invention is the provision of a leg adjusting device for a four-legged, self-leveling cabinet in which all legs are movable in unison as the cabinet is leveled, the legs then being locked with the cabinet in the desired position by the simultaneous insertion of a wedge in each leg, and in which the cabinet is suspended on the legs by a continuous cable of predetermined length encircling said cabinet, and in which the simultaneous insertion of each wedge in its respective leg is accomplished by a locking cable interconnecting each wedge and selectively manually tightened or relaxed to effect the locking insertion or release of a wedge in each leg.

A further object of this invention is the provision of a leg adjusting device for a four-legged, self-leveling cabinet in which all legs are moved simultaneously in unison as the cabinet is leveled, the legs then being locked with the cabinet in the desired position by the simultaneous insertion of a wedge in each leg, and in which the cabinet is suspended on the legs by a continuous cable of predetermined length encircling said cabinet, and in which the simultaneous insertion of each wedge in its respective leg is accomplished by a locking cable interconnecting each wedge and selectively manually tightened or relaxed to effect the locking insertion or release of a wedge in each leg, and wherein said manual tightening is accomplished by a lever pivotally mounted on said cabinet and having one end connected to said locking cable and the other end accessible for manual operation.

Further objects and advantages of the present invention will be apparent from the following description, reference being had to the accompanying drawings wherein a preferred embodiment of the present invention is clearly shown.

IN THE DRAWINGS

Figure 1:
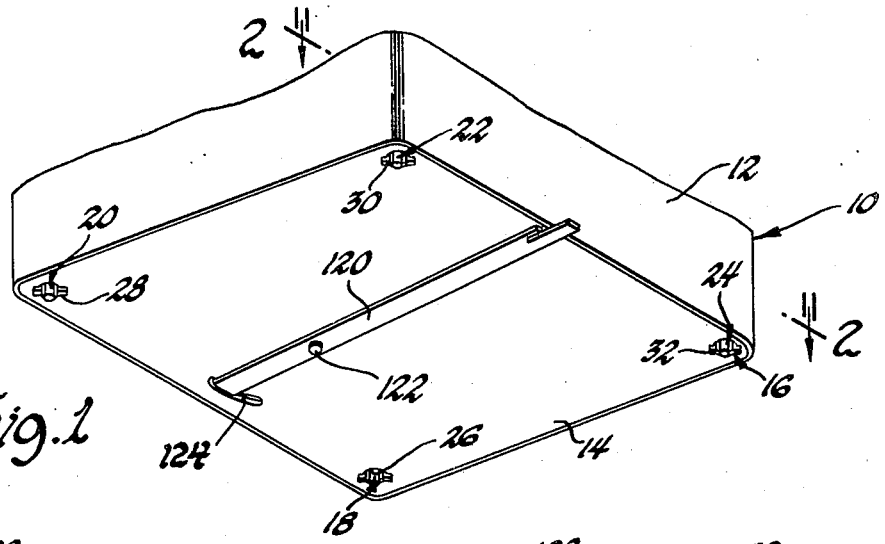
FIG. 1 is a fragmentary bottom perspective view of an appliance cabinet provided with the self-leveling mechanism of this invention.

With particular reference to FIG. 1, a domestic appliance 10 such as a domestic clothes washer or clothes dryer includes a cabinet 12 which is provided with a base plate 14 for receiving and supporting the full-floating, self-leveling quadrupedal cabinet support 16 of this invention.

Figure 3:
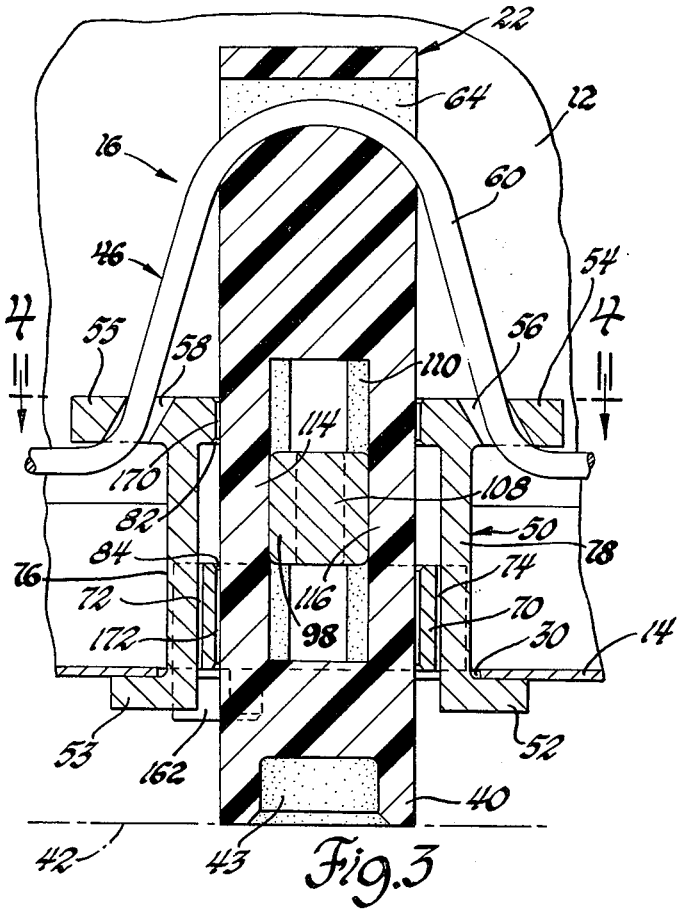
FIG. 3 is a fragmentary side sectional view, partly in elevation, taken along line 3—3 in FIG. 2 showing one of four identical leg assemblies for the self-leveling mechanism.

The self-leveling support 16 includes four leg assemblies 18, 20, 22 and 24 which project respectively through openings 26, 28, 30 and 32 in the base plate 14 at the corners of the cabinet. Each leg assembly 18, 20, 22 and 24 is identical and will be described with reference to leg assembly 22 shown in FIG. 3. In general, leg assembly 22 includes a foot 40 slideably movable with respect to the base plate 14 through hole 30 therein for full-floatingly engaging a fixed surface 42 adjacent the base plate. Surface 42 in a typical installation would be the floor of a laundry room. Thus, foot 40 may have a recess 43 to receive an anti-slip rubber plug or the like. A tension cable assembly 46 interconnects each leg assembly 18, 20, 22 and 24 and urges the foot portion 40 thereof in a direction to engage the surface 42.

More particularly, leg assembly 22, in addition to foot 40, includes an upper foot retainer cup 50, a lower or inner support cup 70 and a wedge 98. The retainer cup has lower flanges 52, 53 as stop means to engage the underside of base plate 14 and upper flanges 54, 55 with angled passageways 56, 58 to receive a cable loop 60 of the tension cable assembly 46 on opposite sides of foot 40, thereby to guide the cable loop as it passes through a passageway 64 in the top of the foot. The inner support cup 70 includes channels 72, 74 for receiving, respectively, legs 76, 78 of the foot retainer cup 50 for locking cups 50, 70 against relative rotation while allowing relative axial movement therebetween. A bottom surface 79 on cup 70 is adapted to engage the top surface of the base plate as a stop means for the support cup when the cup 70 is installed.

Figure 2:
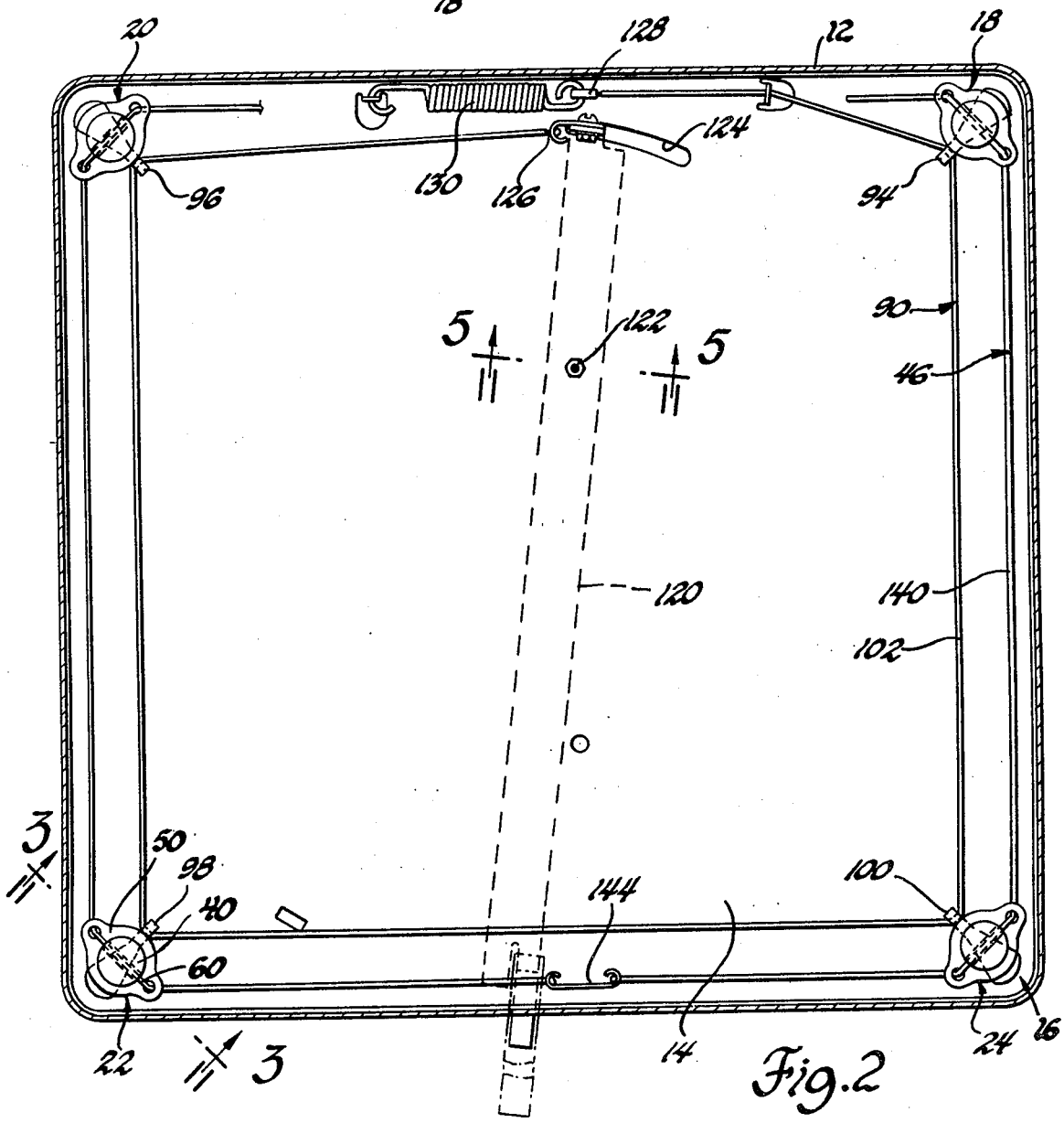
FIG. 2 is a sectional view partly in elevation taken in the direction of arrows 2—2 in FIG. 1.

Both cups 50, 70 have means for gripping and locking foot 40 with respect to the cabinet base plate when the cabinet has been moved to its desired stance. For instance, retainer cup 50 has a peripheral gripping edge 82 while support cup 70 has a peripheral gripping edge 84, both of which edges girdle and grip the expanding outer side of foot 40 in response to operation of a locking cable assembly 90 (FIG. 2).

The locking cable assembly 90 operates to lock each foot against slideable movement with respect to said base plate 14 after the base plate is leveled or in the desired stance. The locking cable assembly 90 includes the inboard ends of wedges or cams 94, 96, 98 and 100 which are interconnected by a locking cable 102. Each wedge includes a tongue portion 106 and a wedge portion 108. The wedge portion fits in a wedge-shaped slot 110 in foot 40 and operates cammingly to spread the foot portions 114, 116 on opposite sides of the slot into a locking connection with the gripping edges 82, 84 of the retainer and support cups 50, 70, respectively.

Wedges 94, 96, 98 and 100 are moved inwardly as locking cable 102 is tensioned. Such tensioning is accomplished in the locking cable assembly 90 by a lever 120 pivotally mounted on a stud 122 attached to the base plate 14 (FIGS. 1 and 2). One end of the lever projects above the base plate 14 through a slot 124 therein for connection with one end 126 of the locking cable. The other end 128 of the locking cable is connected to the base plate 14 by means of a coil spring 130. As viewed in FIG. 2, locking cable 102 is tightened by closkwise movement of lever 120. As the cable is tightened, the wedges are drawn inwardly through the respective slots in the four support feet. This movement expands the outboard sides of the slot into gripping engagement with the gripping edges 82, 84 of the cups.

Each of the four feet 40 move in unison with a full-floating cabinet action depending on the installer who rocks the cabinet as he seeks to level or orient the appliance. For this purpose, the tension cable assembly 46 includes a cable 140 made continuous and of predetermined length by a connector clip 144. Thus, cable 140 extends around the base plate through the opposite flanges 54, 55 in the respective retainer cups 50, and with sufficient slack to form a cable loop 60 between the flanges to trap the respective feet 40. Thus, tension cable assembly 46 drivingly and yieldingly interconnects each respective foot 40 such that rocking of the base plate 14 with respect to the floor 42 causes at least one cable loop 60 to contract and drive its respective foot in a slideable movement toward the floor while at least another cable loop expands and yields to facilitate the slideable movement of its respective foot in a direction away from the floor. The length of cable 140 is constant and predetermined in accordance with the desired foot travel with respect to the base plate 14. In the embodiment shown, foot 40 has a slot 110 which is two inches (50.8 mm.) high to entrap a wedge 108 which is one-half inch (12.7 mm.) high. This provides a foot travel of one and one-half inches (38.1 mm.) with respect to the base plate 14. Thus, if the bottom of each foot is positioned three-quarter inch (19.1 mm.) below the base plate and the cable length made tight at this point, the foot travel of one and onehalf inches is effected below the base plate.

In operation, the installer will release the tension on the locking cable assembly 90 and rock the appliance cabinet 12 until the desired cabinet stance is achieved. Then, he will simply move the lever to tighten the locking cable 102 thereby drawing the wedges into locking engagement with each respective support foot.

Figure 4:
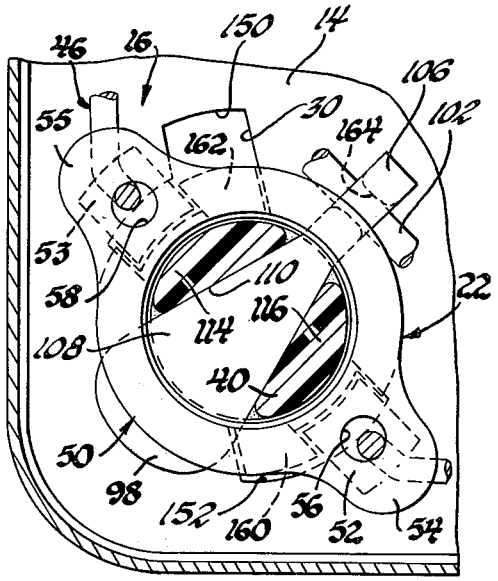
FIG. 4 is a fragmentary top sectional view, partly in elevation, taken along line 4—4 in FIG. 3.
Figure 5:
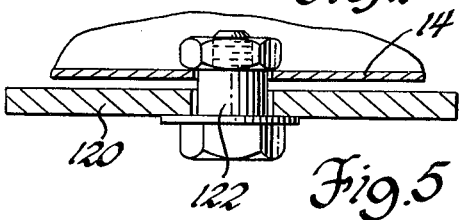
FIG. 5 is a fragmentary side sectional view, partly in elevation taken along line 5—5 in FIG. 2 to show the mounting arrangement of the lever used to manually lock the leg assemblies with the appliance cabinet in a desired stance.
Figure 6:
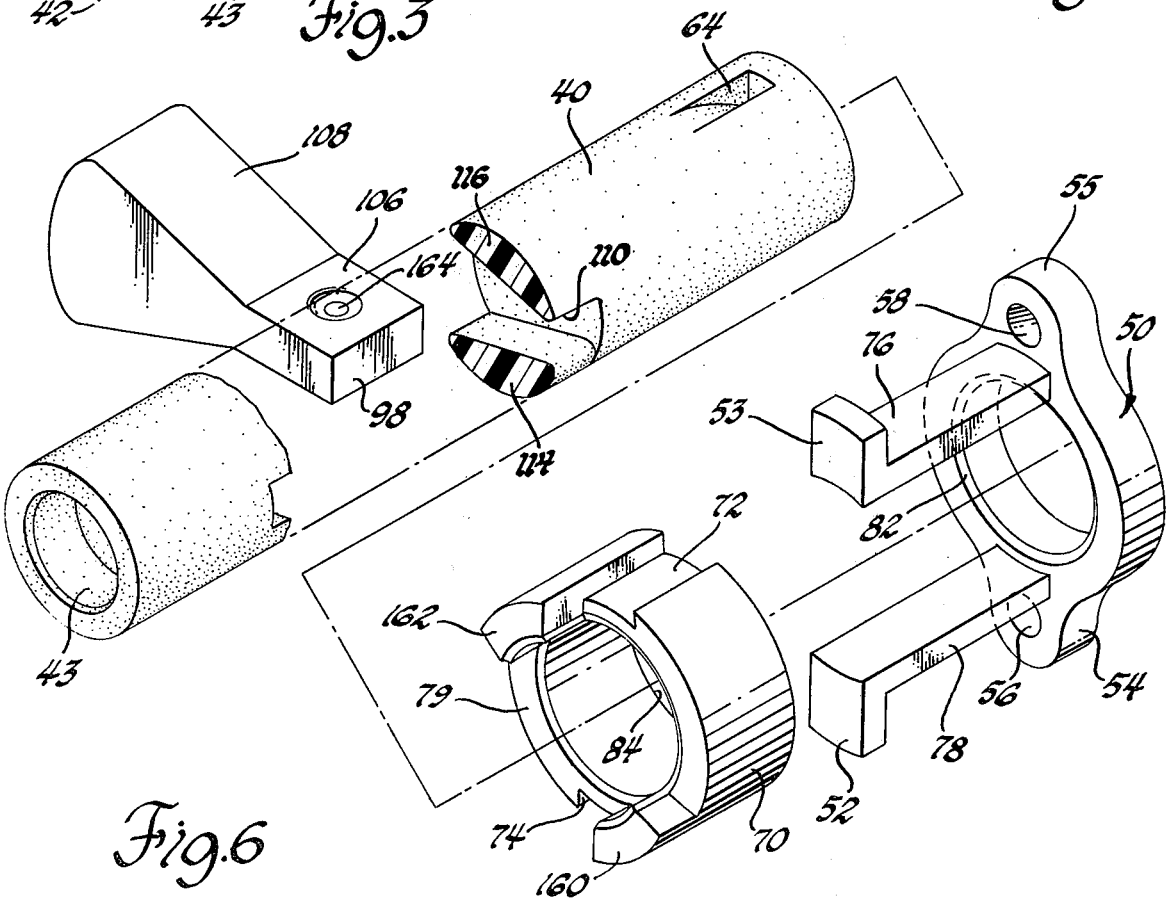
FIG. 6 is an exploded perspective view of one of the leg assemblies of this invention.

The self-leveling mechanism 16 is installed on an appliance cabinet 12 as follows. Subassemble each retainer cup 50 with support cup 70. Slide the subassembly into the base plate and turn. For this purpose, opening 30 (FIG. 4), for instance, in base plate 14 is irregular. It has outboard notch portions 150, 152 to pass through the flanges 52, 53 on the retainer cup 50 and extensions 160, 162 on support cup 70. Each retainer cup 50 is lifted so the support cup 70 drops against the top side of the base plate 14, thereby sandwiching the base plate between the top of the retainer cup flanges and the bottom of the support cup. Each wedge is inserted in its respective leg slot on top of the support cup and oriented to receive the locking cable 102 which is threaded through holes 164 in the inboard tongue portions 106 thereof. Tension cable 140 is then threaded through flange passageways 56, 58 of the retainer cup and foot passageways 64 with the ends of the cable being joined by clip 144 in the desired predetermined length. Lastly, the lever arm 120 is pivotally connected to the base plate 14 and the locking cable 102.

In a preferred embodiment, the retainer cups 50 and the support cups 70 are sintered from fairly dense powdered metal. The wedges 94, 96, 98 and 100 are formed of steel or die cast aluminum. The support feet 40 are formed of plastic, such as polypropylene — the important characteristic being the maintenance of gaps 170, 172 between each foot 40 and the circumscribing cups 50, 70 so that each foot can move freely in the leg assembly as the appliance cabinet is leveled. The preferred angle for slot 110 and wedge 108 is 30°.

While the embodiment of the present invention as herein disclosed constitutes a preferred form, it is to be understood that other forms might be adopted.

What is claimed is:

1. A full-floating type, self-leveling support comprising a base plate having openings therein spaced about the periphery thereof, a leg assembly for each opening, each leg assembly including a foot slideably movable with respect to said base plate through the respective opening for full-floatingly engaging a fixed surface adjacent said base plate as said base plate is oriented with respect to said surface, a tension cable assembly interconnecting each foot and urging each foot in a direction to engage said surface, and a locking cable assembly for locking each foot against slideable movement with respect to said base plate after said base plate is oriented, each leg assembly including a foot retainer means having stop means engaging said base plate on one side thereof at a respective opening and a support means in juxtaposition with said retainer means and having stop means engaging said base plate on the other side thereof to sandwich said base plate therebetween, both said retainer means and support means having gripping means loosely, guidingly supporting a respective foot throughout slideable movement thereof relative to said retainer means and support means, said tension cable assembly including a continuous cable means of predetermined length extending around said base plate through opposite portions on each foot retainer means and with sufficient slack to form a loop between said opposite portions drivingly and yieldingly interconnected with each respective foot such that rocking of said base plate with respect to said surface will cause at least one of said loops to drive its respective foot in a slideable movement toward said surface while at least another of said loops yields to facilitate the slideable movement of its respective foot in a direction away from said surface, said locking cable assembly including a slot in each foot along a longitudinal dimension thereof, a cam of lesser longitudinal dimension than said slot and relatively, slideably movable therewith both longitudinally and transversely, said cam located between said gripping means and oriented with respect to said base plate to lock said retainer means and support means on said base plate against unlimited movement in a direction toward said surface, a locking cable means connected at one end with respect to said base plate and extending around said base plate for interconnecting each oriented cam to assemble all leg assemblies on said base plate, and lever means pivotally mounted with respect to said base plate and connected to the other end of said locking cable means, the pivotal movement of said lever means tensioning said locking cable means to slideably move said cams transversely into sliding engagement with the sides of respective slots to spread said sides into locking engagement with said gripping means, thereby to prevent slideable movement of each foot longitudinally with respect to said base plate and thus out-of-orientation movement of said base plate with respect to said fixed surface.

2. A full-floating type, self-leveling quadrupedal support for a domestic appliance or the like comprising a base plate having four holes therein spaced about the periphery thereof, a leg assembly for each hole, each leg assembly including a foot slideably movable with respect to said base plate through the respective holes for full-floatingly engaging a fixed surface adjacent said base plate as said base plate is leveled with respect to said surface, a tension cable assembly interconnecting each foot and urging each foot in a direction to engage said surface, and a locking cable assembly for locking each foot against slideable movement with respect to said base plate after said base plate is leveled, each leg assembly including a foot retainer cup having stop means engaging said base plate on one side thereof at a respective hole and a support cup inside said retainer cup having stop means engaging said base plate on the other side thereof to sandwich said base plate therebetween, both of said cups having gripping means spaced a slight distance from said foot for loosely, guidingly supporting a respective foot throughout its slideable movement, said tension cable assembly including a continuous cable of predetermined length extending around said base plate through opposite flanges on each foot retainer cup and with sufficient slack to form a loop between said flanges drivingly and yieldingly interconnected with each respective foot such that leveling of said base plate with respect to said surface will cause at least one of said loops to drive its respective foot in a slideable movement toward said surface while at least anoher of said loops yields to facilitate the slideable movement of its respective foot in a direction away from said surface, said locking cable assembly including a wedge-like slot in each foot along a longitudinal dimension thereof, a wedge of lesser longitudinal dimension than said slot and relatively, slideably movable therewith both longitudinally and transversely, said wedge located between said gripping means on both cups and oriented with respect to said base plate to lock said cups on said base plate against unlimited movement in a direction toward said surface, a locking cable connected at one end to said base plate and extending around said base plate for interconnecting each oriented wedge to assemble all leg assemblies on said base plate, and a lever pivotally mounted on said base plate and connected to the other end of said locking cable, the pivotal movement of said lever tensioning said locking cable to slideably move said wedges transversely into sliding engagement with the sides of respective slots to spread and bow said sides into locking engagement with the gripping means of respective cups, thereby to prevent slideable movement of each foot longitudinally with respect to said base plate and subsequent out-of-level movement of said base plate with respect to said fixed surface.

3. A full-floating type, self-leveling quadrupedal support for a domestic appliance or the like comprising a base plate having four holes therein spaced about the periphery thereof, a leg assembly for each hole, each leg assembly including a foot slideably movable with respect to said base plate through the respective holes for full-floatingly engaging a fixed surface adjacent said base plate as said base plate is leveled with respect to said surface, a tension cable assembly interconnecting each foot and urging each foot in a direction to engage said surface, and a locking cable assembly for locking each foot against slideable movement with respect to said base plate after said base plate is leveled, each leg assembly including a foot retainer cup having stop means engaging said base plate on one side thereof at a respective hole and a support cup inside said retainer cup having stop means engaging said base plate on the other side thereof to sandwich said base plate therebetween, both of said cups having gripping means spaced a slight distance from said foot for loosely, guidingly supporting a respective foot throughout its slideable movement, said tension cable assembly including a continuous cable of predetermined length extending around said base plate through opposite flanges on each foot retainer cup and with sufficient slack to form a loop between said flanges drivingly and yieldingly interconnected with each respective foot such that leveling of said base plate with respect to said surface will cause at least one of said loops to drive its respective foot in a slideable movement toward said surface while at least another of said loops yields to facilitate the slideable movement of its respective foot in a direction away from said surface, said locking cable assembly including a wedge-like slot in each foot along a longitudinal dimension thereof, a wedge of lesser longitudinal dimension than said slot and relatively, slideably movable therewith both longitudinally and transversely, said wedge located between said gripping means on both cups and oriented with respect to said base plate to lock said cups on said base plate against unlimited movement in a direction toward said surface, a locking cable connected at one end to said base plate and extending around said base plate for interconnecting each oriented wedge to assemble all leg assemblies on said base plate, and a lever pivotally mounted on said base plate and connected to the other end of said locking cable, the pivotal movement of said lever tensioning said locking cable to slideably move said wedges transversely into sliding engagement with the sides of respective slots to spread and bow said sides into locking engagement with the gripping means of respective cups, thereby to prevent slideable movement of each foot longitudinally with respect to said base plate and subsequent out-of-level movement of said base plate with respect to said fixed surface, the connection of said one end of said locking cable to said base plate being by means of a spring which has the characteristic of preventing overstressing of said locking cable while facilitating the movement of said wedges to effect said locking engagement.

4. A full-floating type, self-leveling quadrupedal support for a domestic appliance or the like comprising a base plate having four holes therein spaced about the periphery thereof, a leg assembly for each hole, each leg assembly including a foot slideably movable with respect to said base plate through the respective holes for full-floatingly engaging a fixed surface adjacent said base plate as said base plate is leveled with respect to said surface, a tension cable assembly interconnecting each foot and urging each foot in a direction to engage said surface, and a locking cable assembly for locking each foot against slideable movement with respect to said base plate after said base plate is leveled, each leg assembly including a foot retainer cup having stop means engaging said base plate on one side thereof at a respective hole and a support cup inside said retainer cup having stop means engaging said base plate on the other side thereof to sandwich said base plate therebetween, both of said cups having gripping means spaced a slight distance from said foot for loosely, guidingly supporting a respective foot throughout its slideable movement, said tension cable assembly including a continuous cable of predetermined length extending around said base plate through opposite flanges on each foot retainer cup and with sufficient slack to form a loop between said flanges drivingly and yieldingly interconnected with each respective foot such that leveling of said base plate with respect to said surface will cause at least one of said loops to drive its respective foot in a slideable movement toward said surface while at least another of said loops yields to facilitate the slideable movement of its respective foot in a direction away from said surface, said locking cable assembly including a wedge-like slot in each foot along a longitudinal dimension thereof, a wedge of lesser longitudinal dimension than said slot and relatively, slideably movable therewith both longitudinally and transversely, the angular opening of said wedge-like slots and the angle of each wedge being 30°, said wedge located between said gripping means on both cups and oriented with respect to said base plate to lock said cups on said base plate against unlimited movement in a direction toward said surface, a locking cable connected at one end to said base plate and extending around said base plate for interconnecting each oriented wedge to assemble all leg assemblies on said base plate, and a lever pivotally mounted on said base plate and connected to the other end of said locking cable, the pivotal movement of said lever tensioning said locking cable to slideably move said wedges transversely into sliding engagement with the sides of respective slots to spread and bow said sides into locking engagement with the gripping means of respective cups, thereby to prevent slideable movement of each foot longitudinally with respect to said base plate and subsequent out-of-level movement of said base plate with respect to said fixed surface, the connection of said one end of said locking cable to said base plate being by means of a spring which has the characteristic of preventing overstressing of said locking cable while facilitating the movement of said wedges to effect said locking engagement.

* * * * *